US005377964A

United States Patent [19]

Haller

[11] Patent Number: 5,377,964

[45] Date of Patent: Jan. 3, 1995

[54] DEVICE FOR CUTTING A WEB INTO SECTIONS

[75] Inventor: Ralf Haller, Oftersheim, Germany

[73] Assignee: Heidelberger Druckmaschinen AG, Heidelberg, Germany

[21] Appl. No.: 11,219

[22] Filed: Jan. 29, 1993

[30] Foreign Application Priority Data

Jan. 29, 1992 [DE] Germany ..... 4202363

[51] Int. Cl.[6] ..... B41F 13/56

[52] U.S. Cl. ..... 270/21.1; 270/4; 270/5; 83/22

[58] Field of Search ..... 270/21.1, 4, 5, 41, 270/42, 10, 54, 52.5, 1.1; 83/22, 102

[56] References Cited

U.S. PATENT DOCUMENTS

| | | | |
|---|---|---|---|
| 3,843,483 | 10/1974 | Sendor et al. | 270/5 |
| 4,939,888 | 7/1990 | Katz | 270/4 |
| 4,966,352 | 10/1990 | Nuttin | 270/1.1 |
| 4,974,822 | 12/1990 | Richter | 270/21.1 |
| 5,149,075 | 9/1992 | Crowley et al. | 270/52.5 |

OTHER PUBLICATIONS

Bulletin: 402 5M Oct. 1987 of Blava Inline, Inc., New Jersey.

*Primary Examiner*—John T. Kwon

*Attorney, Agent, or Firm*—Herbert L. Lerner; Laurence A. Greenberg

[57] ABSTRACT

In a combination of a rotary printing press having a drive, and a device for cutting a web into sections, the device is disposed downline from the rotary printing press in travel direction of a web therethrough and includes a cutting station having a drive dependent upon the drive of the rotary printing press; a pre-folding station disposed upline of the cutting station and connected to the drive of the cutting station, the pre-folding station including, for the web, at least one register-adjusting roller, at least one pull roller and at least one funnel for folding the web, and the cutting station including a cut-register sensor; and a structure defining a horizontal travel plane for the folded web, the horizontal travel plane extending from the pre-folding station to at least a location upline and adjacent the cut-register sensor.

14 Claims, 3 Drawing Sheets

DEVICE FOR CUTTING A WEB INTO SECTIONS

SPECIFICATION

The invention relates to a device for cutting a web which, more particularly, may also be formed of a plurality of partial webs, into sections.

A rotary cross-cutting device has become known heretofore the prior art as disclosed in a bulletin 402 5M 10/87 of Blava Inline, Inc., Hackensack, N.J. The rotary cross-cutting device described therein is formed of a double-funnel pre-folding unit and of a cutting unit with multistream product delivery disposed downline from the pre-folding unit. With such a configuration of a cross-cutting device, the setting of the page-to-page fine register is performed beforehand in the pre-folding unit. Folded paper webs arriving in the cutting unit from the pre-folding unit are subject to variations in web tension, so that the page-to-page fine register set in the pre-folding unit is adversely affected. No opportunity is provided for performing a correction in the cutting unit which is disposed downline of the pre-folding station. This potential source of error constitutes a decided disadvantage of the cross-cutting configuration heretofore known from the aforementioned bulletin 402 5M 10/87. Moreover, the pre-folding station and the cutting unit have one drive, so that, for example, there is no possibility of performing a relative adjustment between the two units.

It is, accordingly, an object of the invention to provide a device for cutting a web into sections, wherein folded weds of different material thicknesses are processed in a crease-free manner, even at high web speeds.

With the foregoing and other objects in view, there is provided, in accordance with the invention, in combination, a rotary printing press having a drive, and a device for cutting a web or a plurality of partial webs into sections, the device being disposed downline from the rotary printing press in travel direction of a web therethrough and comprising a cutting station having a drive dependent upon the drive of the rotary printing press; a pre-folding station disposed upline of said cutting station and connected to the drive of the cutting station, the pre-folding station comprising, for the web, at least one register-adjusting roller, at least one pull roller and at least one funnel for folding the web, and the cutting station comprising a cut-register sensor; and means defining a horizontal travel plane for the folded web, the horizontal travel plane extending from the pre-folding station to at least a location upline and adjacent the cut-register sensor.

Advantages of this configuration are that the register adjustment of the folded web takes place just before cutting and, therefore, all web-affecting displacements, changes in tension, and the like, occurring up to that instant of time are taken into account in the register adjustment and cutting is always performed within extremely narrow cutting tolerances. The connection of the pre-folding unit to the drive of the cutting station ensures that an initial coarse register adjustment will take place beforehand in the pre-folding unit and reduces the register adjustment in the cutting station to an indispensable minimum, so that high processing speeds are attainable. The arrival of the folded web in a strictly horizontal disposition in the cutting station minimizes the looping or gripping angles of the guide rollers, thereby preventing induced tensions within a folded web, which may become noticeable in the form of creases and wrinkles along the fold, particularly in the case of thicker papers.

In accordance with another feature of the invention, the drive of the cutting station comprises a separate drive motor, the cut-register sensor having a pulse generator by which the separate drive motor is synchronously readjusted to the drive of the rotary printing press.

This construction ensures that, in an advantageous manner, the pre-folding station and the cutting station may be placed a distance away from the printing press, e.g., at a right angle thereto, if there is a space shortage, or even on another floor. Mechanical connecting parts can be dispensed with. Different web distances to the cutting station require different coarse-register settings of the cut. These settings can be elegantly influenced by the separate drive by actuating a plus/minus jog key at the cutting station.

In accordance with a further feature of the invention, the pulses of the pulse generator cut-register sensor are superimposed on the drive of the cutting station. A permanent fine-register adjustment is thereby automatically provided directly before each cross-cutting operation.

In accordance with an added feature of the invention, the drive of the cutting station is a slave drive, and the pre-folding station is associated with another slave drive, and including respective converters via which the slave drives are controllably connected to a master motor of the rotary printing press. This configuration permits a targeted influencing of the paper transport taking place in the pre-folding station and, depending upon the requirements of the specific application, permits a reduction in the stresses occurring on the web of material.

In accordance with an additional feature of the invention, means are provided at the cutting station for selectively processing, in a fixed-format and variable-format manner, respectively, the folded web arriving at the cutting station. By performing a slight adjustment of the cutting anvil in the cutting bed, it is possible, depending upon the quality of paper to be processed, for the cut to be performed either as a shears cut or as a squeeze cut. Thus, in accordance with alternative features of the invention, the cutting station comprises a cutting cylinder having means for cutting off copies by squeeze-cutting and/or means for cutting off copies by shears cutting.

The copies may be conveyed aerodynamically or pneumatically by means of blow nozzles, suction nozzles and suction rollers or, alternatively, via a system of conveyor belts. Thus, in accordance with the invention, means are provided at the cutting station for cutting off copies from the folded web, and means are further provided for conveying the cut-off copies via air nozzles and hover rails to a copy pile. Alternatively, a cutting cylinder is provided at the cutting station, and there is further included at least one conveyor belt disposed downline from the cutting cylinder.

In accordance with yet another feature of the invention, a cutting cylinder is included at the cutting station for cutting off copies from the folded web, and pneumatic means are provided downline from the cutting cylinder for effecting a mutual overlapping of the copies, the pneumatic means comprising suction nozzles disposed above and below a travel plane for the copies, and suction rollers.

In accordance with an alternative feature of the invention, a cutting cylinder is included at the cutting station for cutting off copies from the folded web, and rotating cams are disposed downline from the cutting cylinder for effecting a mutual overlapping of the copies. In this regard, the revolving cams, as-viewed in the travel direction of the copies, act upon a respective rear part of the copies.

In accordance with yet a further feature of the invention, the cutting station comprises a main-pile and an auxiliary-pile device.

In accordance with yet an added feature of the invention, a cutting cylinder is provided at the cutting station for cutting off copies from a plurality of folded webs conveyed thereto from the pre-folding station, and at least one copy-conveying system is included for delivering substreams of the copies in mutually overlapping condition from the cutting station.

Accordingly, the delivery of copies from the cutting station may be effected by one or more copy conveyor or transport systems, for example, in the form of belt conveyors, which convey the copies in a continuous mutually overlapping stream out of the cutting station.

In accordance with a concomitant feature of the invention, a wetting unit is disposed at an upline location of the cutting station and has means for wet-treating both upper and lower sides of the folded web. Thus, the wetting unit permits both sides of the web to be treated at the entry or prior to entry thereof into the cutting station and, in the case of a non-folded web, permits good and reliable delivery of the cut sheets. The wetting liquid, which is formed of water and additives to reduce surface tension, prevents or eliminates static charges. Additions of silicone emulsions make the paper supple and prevent setting-off of ink at contact locations.

Other features which are considered as characteristic for the invention are set forth in the appended claims.

Although the invention is illustrated and described herein as embodied in a device for cutting a web into sections, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
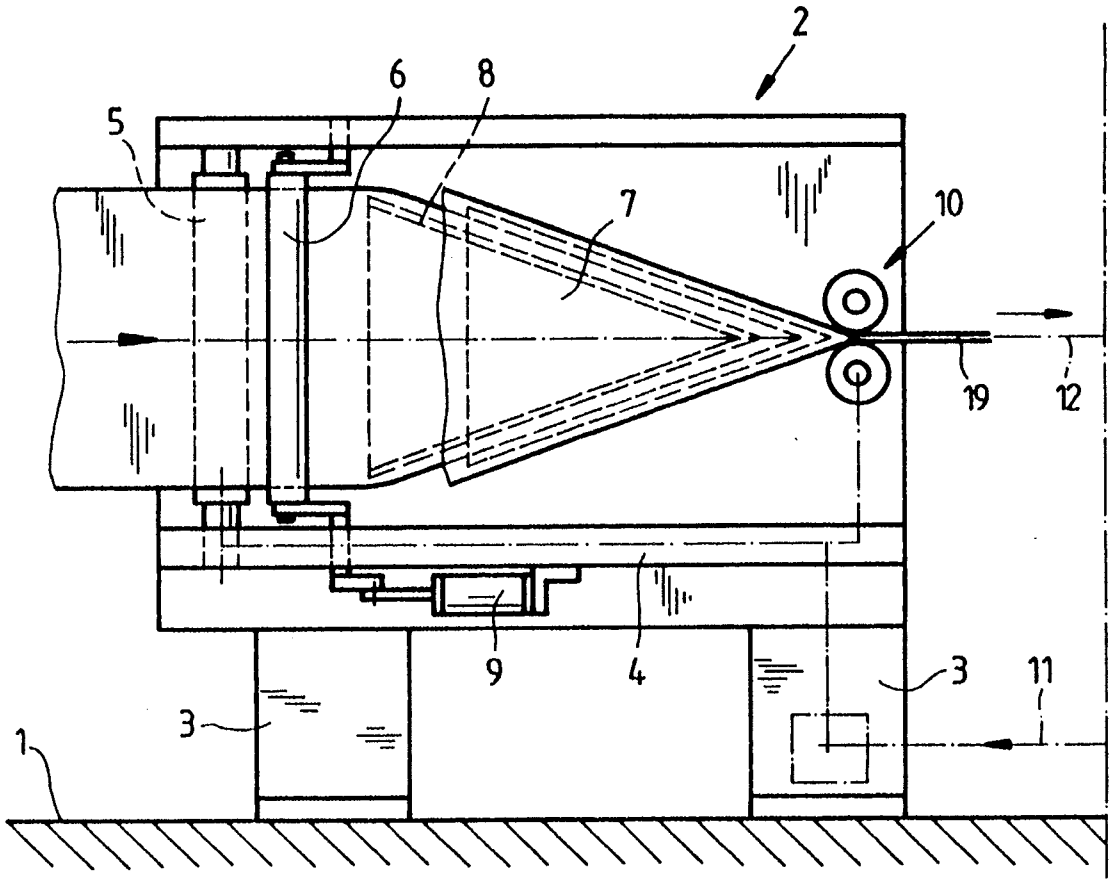
FIG. 1 is a diagrammatic side elevational view of a pre-folding unit disposed at a given station.
Figure 2:
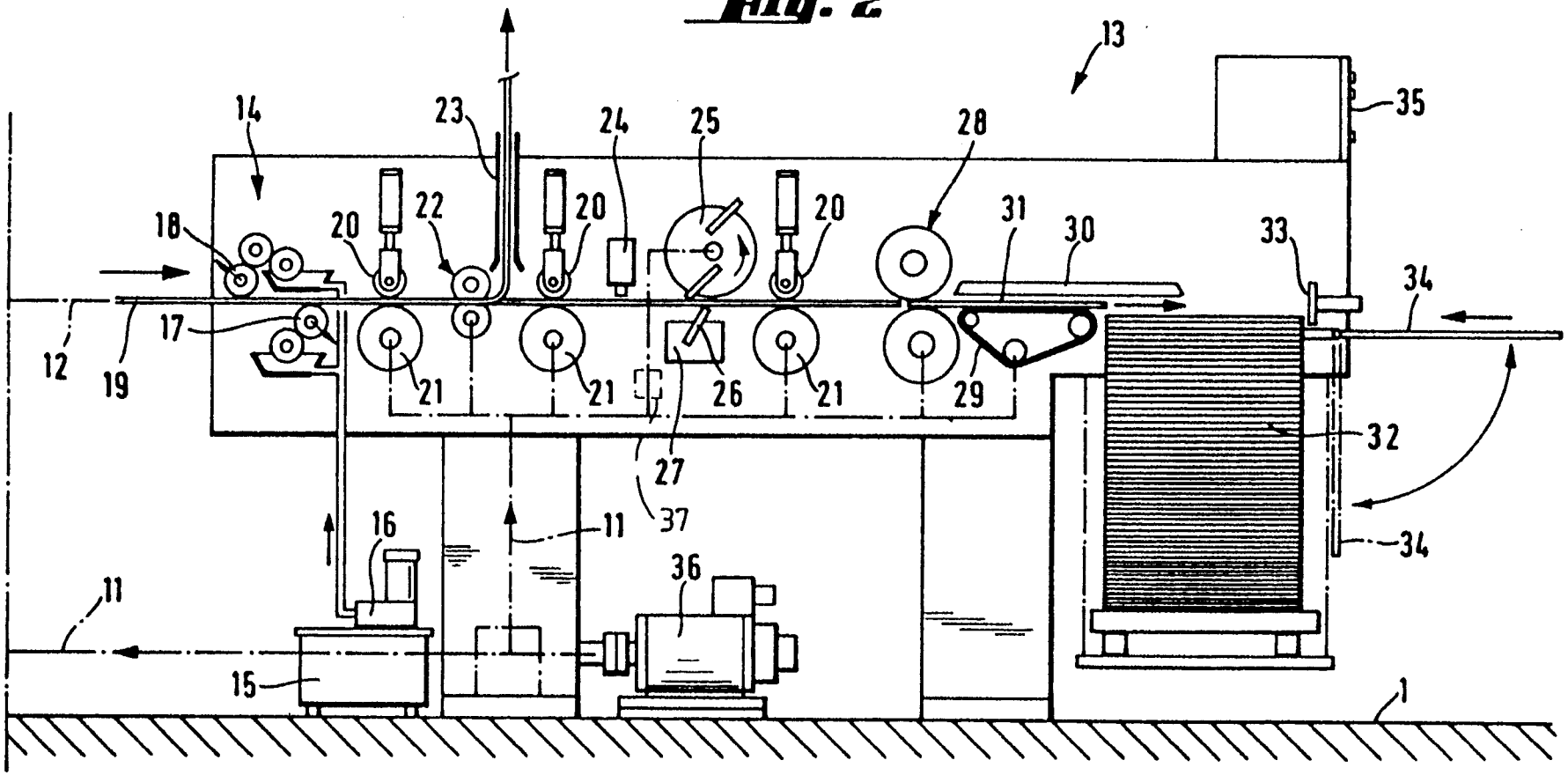
FIG. 2 is a diagrammatic side elevational view of a cutting unit at another station disposed downline from the pre-folding station.

Referring now to the drawings and, first, particularly to FIGS. 1 and 2 thereof, a pre-folding unit at a station 2 and a cutting unit at a station 13 are disposed on a base 1. The pre-folding station 2 rests on a substructure 3. A frame structure 4 inside the pre-folding station 2 accommodates internals of the pre-folding station 2, including a number of pull or draw rollers 5 and register-adjusting rollers 6, the exact number thereof corresponding to the number of partial webs entering the pre-folding station 2. In the example shown, two partial webs enter the pre-folding station 2. Each partial web is thus associated with a pull or draw roller 5 and a register-adjusting roller 6, as well as one of two funnels 7 and 8. The pull roller 5 is connected to and controllable by a drive 36 of the cutting station 13 through the intermediary of a drive train 11, which extends through the frame structure 4 and the substructure 3. Non-illustrated, but forming part of the pre-folding station 2, are longitudinal-cutting devices and adjustable turning bars for dividing the web and feeding it to the respective funnels 7,8. The register-adjusting roller 6 is adjusted by means of a servo-drive 9. The servo-drive 9 can be operated and preset, respectively, both by a pressman or other printing-press personnel directly and also as part of the presetting process.

After the partial webs have passed the funnels 7 and 8, respectively, with which they are associated, and have thus been longitudinally folded, the partial webs are fed simultaneously or side-by-side to the cutting station 2. The webs 19 then pass adjustable roller pairs 10 in order to stabilize the fold before they leave the pre-folding station 2.

If the cutting station 13 is to cross-cut a normal non-folded web instead of a web which has been previously folded, the pre-folding station 2 is bypassed by means of non-illustrated diversion or deflecting rollers so that the web 19 then enters a wetting unit 14, which is disposed upline of the cutting station 13, as viewed in travel direction of the web 19. Non-folded webs need not necessarily enter the cutting station 13 horizontally.

The web 19 running into the wetting unit 14 of the cutting station 13 can be treated on both sides thereof in the wetting unit 14 by applicator rollers 17 and 18, respectively. For this purpose, liquid is pumped by a pump 16 into the wetting unit 14 from a tank 15 placed below the cutting station 13. After the web 19 passes through the wetting unit 14 wherein it optionally may be treated, the web 19, which continues to be horizontally guided, enters the cutting station 13.

Provided above the web 19 are pneumatically operated pressure rollers 20, which cooperate with transport rollers 21 and convey the web 19 through the cutting station 13. After passing a first pull or draw unit, made up of pressure rollers 20 and transport rollers 21, the web 19 is cut longitudinally by a diagrammatically represented longitudinal cutting device 22. It is believed to be readily apparent that the device 22 has longitudinal cutting blades which can be adjusted perpendicularly to the plane of the drawing. A trim remover or extractor 23 suitably ejects from the cutting station 13 web-edge portions which have been cut from the web 19. The non-folded or folded web 19 is then drawn through a second pull or draw unit, likewise formed of pressure rollers 20 and transport rollers 21, towards a cutting cylinder 25.

The web 19 passes a cut-register sensor 24 which, by detecting register marks or by any suitable alternative method, registers with respect to one another the pages of a copy 31 to be cut. Cut-register sensors 24, respectively, may be provided both above and below the web 19. The pulses of the cut-register sensor 24 are superimposed upon the drive 36 and, in this manner, influence a drive of the cutting cylinder 25, which adjusts the position of the cross-cut within specified tolerances. The precise position of the cut can thus be assured. All parameters influencing the web 19 can be measured and, by being measured immediately before execution of the cross-cut, can be taken into account.

As shown in FIG. 2 of the drawing, the drive 36 is a separate drive motor which, as a slave motor, synchronously follows or is readjusted to the main drive of the printing press. The pulses of the cut-register sensor 24 are superimposed upon the drive 36. In a possible further embodiment of the invention, a superimposing gear unit or transmission 37 is provided between the drive motor 36 and the drive of the cutting cylinder 25. Correction pulses from the sensor 24 would then be supplied to the superimposing gear unit 37. Coarse register is then adjusted with the motor 36, and fine register with the superimposing gear unit 37. Adjustment may be effected, for example, by a stepping motor. The drive of the pre-folding station 2 is effected in a similar manner via the drive train 11. Blades mounted on an outer cylindrical surface of the cutting cylinder 25 cooperate with a blade bar 26 which is mounted in a blade bed 27 in a position which is adjustable to suit specific requirements. As the web 19 passes through the cutting station, individual copies or signatures 31 are correctly cut therefrom and may be brought into a mutually overlapping relationship either by rotating revolving cams or by pneumatic means. In this regard, for example, rollers of a roller pair 28 may be formed as suction rollers. A further possible way for causing the copies to overlap is to decelerate the copies 31 by means of suction nozzles disposed in the plane of travel of the copies. This may also be achieved by reducing the conveying speed of a third pull or draw unit which is formed of pneumatic pressure rollers 20 and transport rollers 21 and which is disposed between the cutting cylinder 25 and the roller pair 28.

In the embodiment of the invention illustrated in FIGS. 1 and 2, the copies are delivered via a copy or signature pile 32 whereon the copies 31 are deposited after being braked by a stop 33. The copies 31 are conveyed to the copy pile 32 on at least one conveyor belt 29, above which a hover rail 30 supplied with blowing air may be secured for the purpose of assisting in the braking of the copies 31. A continuous deposition of the copies 31 can be achieved by providing a non-stop slide 34 which, when required, accepts the copies 31 on pallets, for example, while the main pile 32 is carried away.

Disposed above the non-stop slide 34 is a control panel 35, by means of which the pressman or other printing-press personnel may appropriately intervene and effect fine adjustments, such as cut-register adjustments, for example. It is thus possible, for example, to meter the quantity of liquid to be applied to the web 19 or to actuate the longitudinal-cutting device or to activate non-stop operation, all at the control panel 35.

Figure 3:
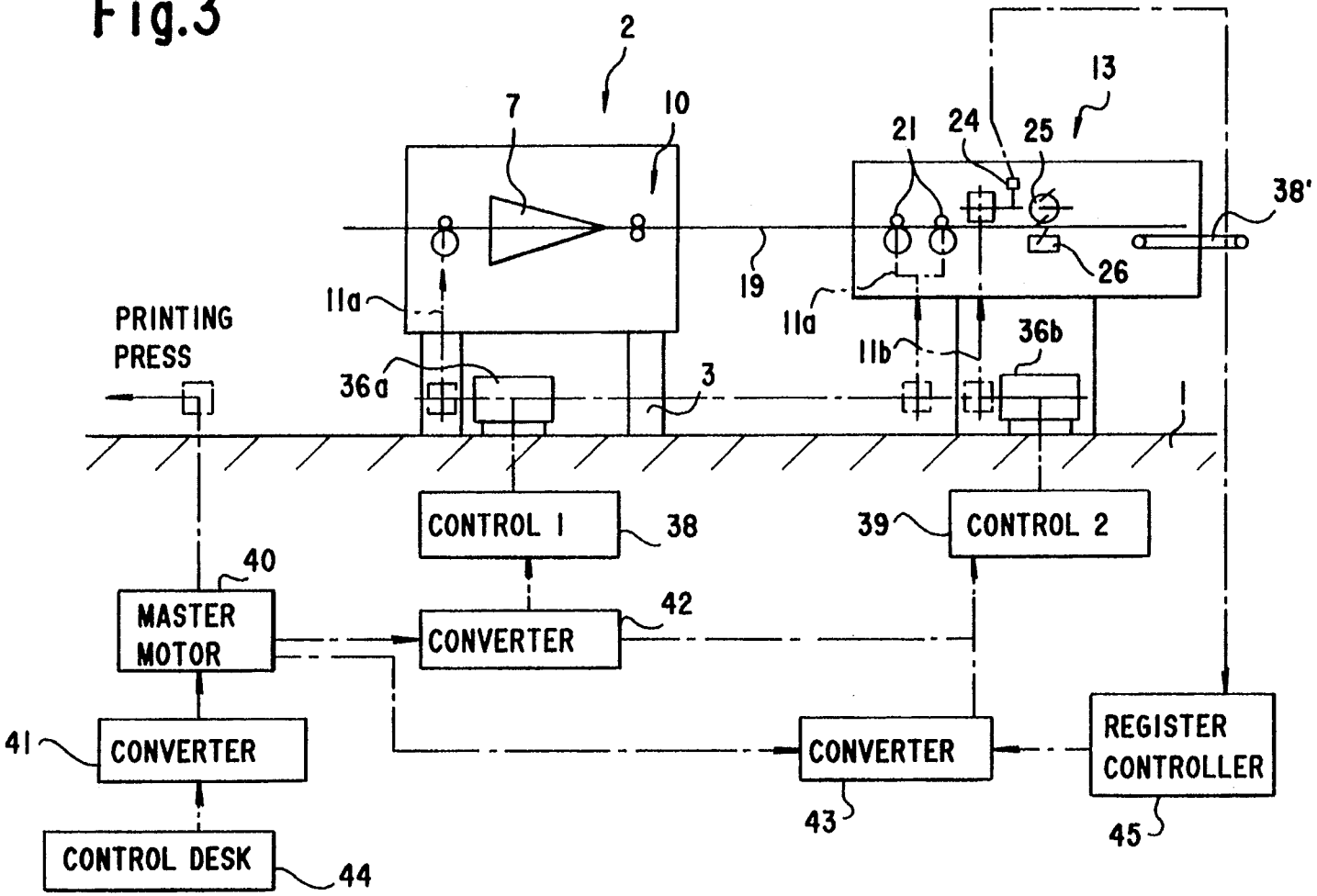
FIG. 3 is a highly diagrammatic and schematic side elevational composite view of the pre-folding and cutting units at the respective stations thereof, but having a different embodiment of a drive therefor which employs slave motors.

A further possible embodiment of the invention is shown in FIG. 3 and provides, instead of a pile delivery, a conveyer belt 38 which is disposed below the hover rail 30. In such a case, the pile system is shut down. With the conveyor belt 38, the copies 31 can be removed in a continuous stream from the cutting station 13 and can pass through a downline further-processing station. To accommodate specific production requirements, the conveyor-belt systems can be installed with just a few manual operations and can just as easily be removed for pile operation.

Differing from the embodiment of FIGS. 1 and 2, the embodiment of FIG. 3 shows a drive employing two slave motors. This configuration includes two slave-motor controls 38 and 39 after-connected to a master motor 40 and each controlling a slave drive **36*a* and 36*b*, respectively. The pre-folding station 2 (shown very diagrammatically in FIG. 3) and the pull or draw rollers 21 of the cutting station 13 may be driven by the slave drive 36*a* via a drive train 11*a*. The cutting cylinder 25 of the cutting station 13 (likewise shown very diagrammatically) is driven by the slave drive 36*b* via a drive train 11*b***.

The master motor for driving the printing press is controlled directly from a control desk 44 through the intermediary of a converter 41. Other converters 42 and 43, which are dependent upon the master motor, control the slave motors which drive the slave drives **36*a* and 36*b*, respectively, of the pre-folding station and the cutting station. The pulses from the cut-register sensor 24 are also superimposed, via a register controller 45 on the slave motor for the slave drive 36*b*** in order to achieve fine adjustment of the cut register.

This drive configuration permits the pre-folding station 2 and the cutting station 13 to be erected separately from the master motor 40 of the rotary printing press. The control of the slave drives **36*a*, 36*b* permits the pre-folding station 2 and the cutting station 13** to be rotated through an angle of 90° without requiring any complex preliminary work therefor. The device according to the invention may be erected, for example, because of a shortage of space, in rooms other than the room in which the printing press is operated.

I claim:

1. In combination, a rotary printing press having a drive, and a device for cutting a web into sections, the device being disposed downline from the rotary printing press in travel direction of a web therethrough and comprising a cutting station having a drive dependent upon the drive of the rotary printing press; a pre-folding station disposed upline of said cutting station, said pre-folding station having a drive being coupled to said drive of said cutting station, said pre-folding station comprising, for the web, at least one register-adjusting roller, at least one pull roller and at least one funnel for folding the web, and said cutting station comprising cutting means for cutting the web, and a cut-register sensor disposed upline and adjacent said cutting means, said cut-register sensor being operatively connected to a drive of said cutting means for adjusting an exact location of cut on the web; and means defining a horizontal travel plane for the folded web, said horizontal travel plane extending from said pre-folding station to at least a location upline and adjacent said cut-register sensor.

2. Device according to claim 1, wherein said drive of said cutting station comprises a separate drive motor, said cut-register sensor having a pulse generator by which said separate drive motor is synchronously readjusted to the drive of the rotary printing press.

3. Device according to claim 2, wherein the pulses of said pulse generator cut-register sensor are superimposed on said drive of said cutting station.

4. Device according to claim 1, wherein said drive of said cutting station is a slave drive, and said pre-folding station is associated with another slave drive, and including respective converters via which said slave drives are controllably connected to a master motor of the rotary printing press.

5. Device according to claim 1, including means at said cutting station for selectively processing, in a fixed-format and variable-format manner, respectively, the folded web arriving at said cutting station.

6. Device according to claim 1, wherein said cutting station comprises a cutting cylinder having means for cutting off copies by squeeze-cutting.

7. Device according to claim 1, wherein said cutting station comprises a cutting cylinder having means for cutting off copies by shears-cutting.

8. Device according to claim 1, including means at said cutting station for cutting off copies from the folded web, and means for conveying the cut-off copies via air nozzles and hover rails to a copy pile.

9. Device according to claim 1, including a cutting cylinder at said cutting station, and further including at least one conveyor belt disposed downline from said cutting cylinder.

10. Device according to claim 1, including a cutting cylinder at said cutting station for cutting off copies from the folded web, and pneumatic means downline from said cutting cylinder for effecting a mutual overlapping of the copies, said pneumatic means comprising suction nozzles disposed above and below a travel plane for the copies, and suction rollers.

11. Device according to claim 1, including a cutting cylinder at said cutting station for cutting off copies from the folded web, and rotating cams disposed downline from said cutting cylinder for effecting a mutual overlapping of the copies.

12. Device according to claim 1, wherein said cutting station comprises a main-pile and an auxiliary-pile device.

13. Device according to claim 1, including a cutting cylinder at said cutting station for cutting off copies from a plurality of folded webs conveyed thereto from said pre-folding station, and at least one copy-conveying system for delivering substreams of the copies in mutually overlapping condition from said cutting station.

14. Device according to claim 1, including a wetting unit disposed at an upline location of said cutting station and having means for wet-treating both upper and lower sides of the folded web.

* * * * *